United States Patent [19]

Glover et al.

[11] 3,963,296

[45] June 15, 1976

[54] LOCKING BAR ASSEMBLY FOR HIGH VOLTAGE TERMINAL BLOCKS

[75] Inventors: Douglas Wade Glover, Harrisburg; Mervin Amos Gardner, Highspire, both of Pa.

[73] Assignee: AMP Incorporated, Harrisburg,, Pa.

[22] Filed: May 9, 1975

[21] Appl. No.: 576,069

[52] U.S. Cl. ..... 339/75 M; 339/91 R; 339/198 GA

[51] Int. Cl.[2] ..... H01R 9/16

[58] Field of Search ..... 339/75 M, 91 R, 198

[56] References Cited

UNITED STATES PATENTS

| | | | |
|---|---|---|---|
| 2,985,861 | 5/1961 | Rogoff | 339/198 S |
| 3,648,223 | 3/1972 | McCray | 339/75 M |
| 3,824,553 | 7/1974 | Glover | 339/198 GA |

*Primary Examiner*—Roy Lake
*Assistant Examiner*—Mark S. Bicks
*Attorney, Agent, or Firm*—Gerald K. Kita

[57] ABSTRACT

A terminal block for high voltage electrical leads includes a plurality of individual housings into which the terminated leads are received. The housings in turn are pluggably received within cavities of a plurality of modular terminal blocks which are stacked together and interlocked, and which are further mounted along a track. A locking bar partially overlies the cavities in the terminal block preventing removal of the individual housings. The locking bar is resiliently and removably latched to end plates mounted in the track and receiving therebetween the stacked terminal blocks.

3 Claims, 5 Drawing Figures

LOCKING BAR ASSEMBLY FOR HIGH VOLTAGE TERMINAL BLOCKS

FIELD OF THE INVENTION

The present invention relates to an assembly of terminal blocks which provide pluggable electrical connections for electrical leads which are terminated with electrical contacts contained within individual dielectric housings. The housings are then selectively pluggably connected within cavities of the terminal blocks which are stacked together, interlocked and slidably mounted along a common rail or track. A locking bar prevents inadvertent removal of the housings from the cavities. An exemplary terminal block assembly without a locking bar feature is described and shown in U.S. Pat. No. 3,824,553, the disclosure of which is specifically incorporated herein by reference.

The locking bar according to the present invention is in the form of an elongated resilient dielectric extrusion having a pair of resilient flanges. The flanges each include an integral beveled lip. The assembly of terminal blocks is provided with a pair of opposed end plates fabricated from dielectric material and provided with aligned notch portions. The locking bar partially overlies the cavities in the terminal blocks preventing removal of the housings therefrom. The beveled lips of the locking bar latchably register within the notch portions of the end plates slidably mounting the locking bar to the assembly of terminal blocks. Removal of the locking bar is accomplished by resiliently pinching the flange portions toward each other which facilitates withdrawal of the flange portions from the notch portions of the end plates.

OBJECTS

It is accordingly an object of the present invention to provide an assembly of terminal blocks with pluggably received housings together with end plates for the assembly of terminal blocks which removably and latchably receive a slidable locking bar which prevents removal of the housings from the terminal blocks.

Another object of the present invention is to provide a resilient dielectric locking bar for an assembly of terminal blocks wherein the bar is provided with a pair of resilient deflectable flanges which are wedgingly engaged within notch portions of end plates mounted on opposite sides of the assembly of terminal blocks.

Other objects and many attendant advantages of the present invention are readily apparent from the following detailed description of the preferred embodiments and modifications and from the accompanying drawings.

DETAILED DESCRIPTION OF THE PREFERRED EMBODIMENT

Figure 1:
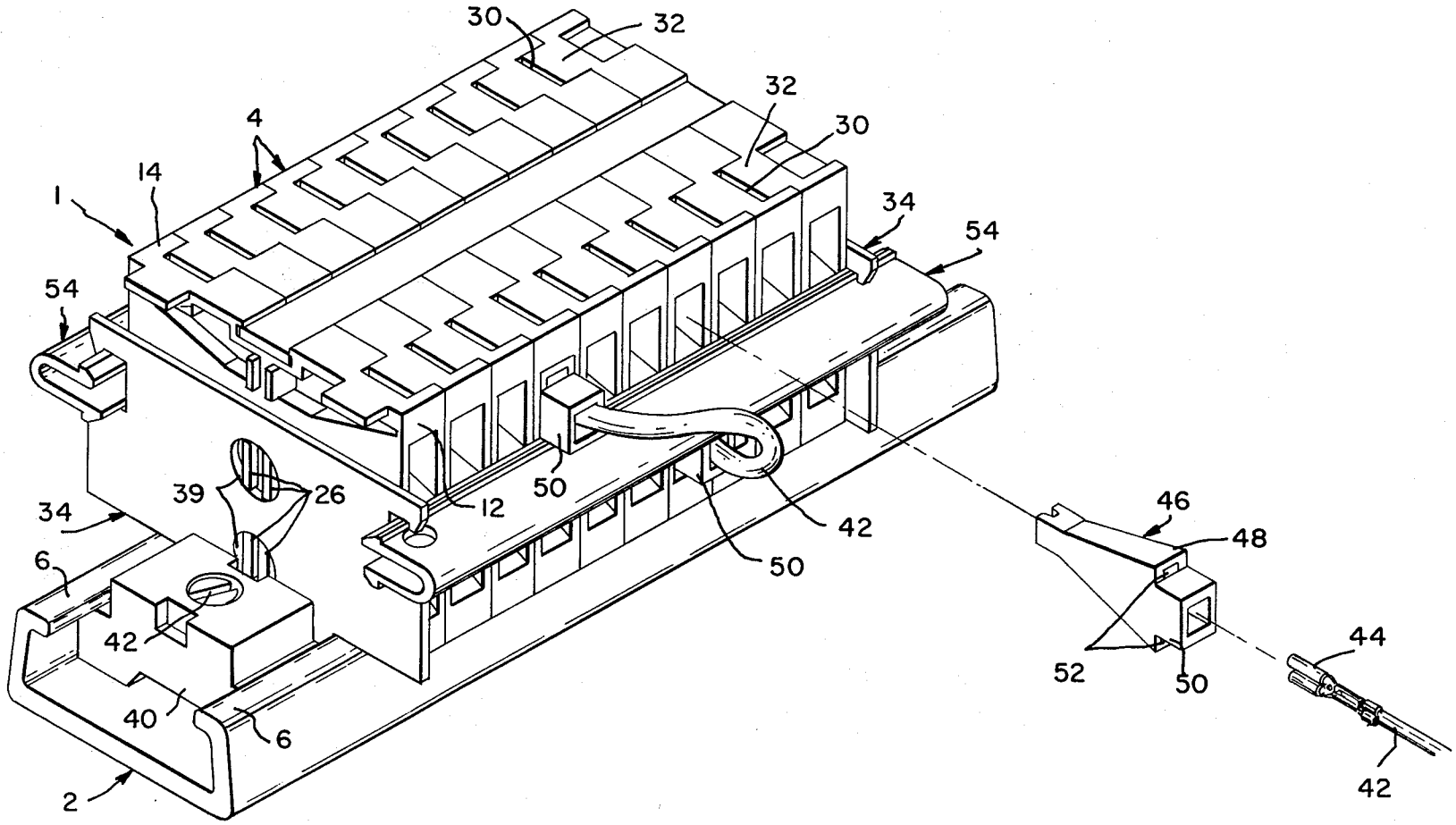
FIG. 1 is a perspective of an assembly of terminal blocks mounted on a rail and containing pluggable electrical leads terminated with contacts contained in individual housings, together with a locking bar preventing removal of the housings from the terminal block assembly.
Figure 2:
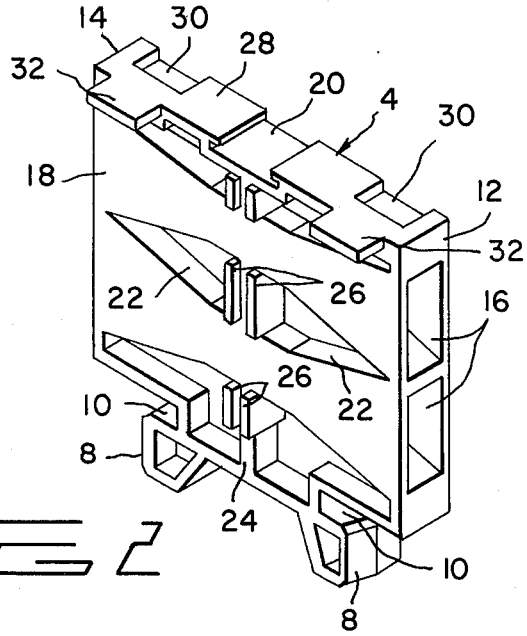
FIG. 2 is an enlarged perspective of a terminal block of the assembly shown in FIG. 1.
Figure 5:
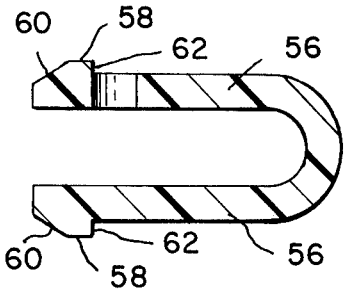
FIG. 5 is an enlarged cross-section of the locking bar shown in FIG. 4.

With more particular reference to FIG. 1 of the drawings there is shown generally at 1 an assembly of terminal blocks 1 according to the present invention provided with a track 2 on which are mounted a plurality of terminal blocks 4 of dielectric material. The elongated track 2 is generally of U-shaped cross-section with the arms of the U having inwardly directed flanges 6. As shown in FIGS. 1 and 2 each terminal block 4 is generally retangular and is provided with an integral base portion defined by a pair of spaced shoes 8 with a groove 10 defined between each shoe 8 and a corresponding rectangular portion of the block 4. Each end 12 and 14 of the block 4 is provided with a pair of cavities 16. Each cavity 16 is generally of tapered configuration. The generally planar side surfaces 18 and 20 of the block 4 are provided with recesses 22 each of which are defined between corresponding cavities 16. A central web 24 separates the cavities 22. Each of the cavities 22 is provided with a laterally projecting flange 26 immediately adjacent to the web 24. It is noted that the flanges 26 project outwardly of the side surface 18, whereas the side surface 20 is purposely devoid of such projecting flanges. The block 4 is provided with a pair of spaced rectangular recesses 30 at the intersection of the top surface 28 and side surface 20. The block 4 is further provided with a pair of spaced rectangular tabs 32 projecting laterally outward from the intersection of the side surface 18 and the top surface 28. A desired number of blocks 4 are assembled in serial fashion along the track 2 by slidable insertion of the shoes 8 within the confines of the track 2 and with the flanges 6 of the track being slidably received in the grooves 10 thereby interlocking each block 4 slidably along the track 2. The blocks 4 are mutually interlocked to form a cluster of blocks by receiving the tabs 32 of one block in seated registration within corresponding recesses 30 of an adjacent block. In addition the laterally projecting flanges 26 projecting from the side 18 of one block will enter corresponding recesses 22 of an adjacent block side 20 with the flanges 26 of one block receiving in seated registration therebetween the projecting flange 24 of an adjacent block. To complete the assembly of blocks 4 to form a cluster of blocks, a pair of end plates 34 are slidably mounted on the track 2 receiving therebetween a cluster of blocks 4.

More particular reference will be made to FIGS. 1 and 3 wherein an end plate is shown with a depending tab 36, the opposite sides of which are provided with aligned recesses 38. The end plates are mounted on the elongated track 2 by insertion of the tabs 36 within the confines of the track and with the recesses 38 slidably receiving the flanges 6, thereby slidably interlocking the end plates to the track 2. Cutouts 39 receive the flanges 26 therein to insure engagement of the end plate flush against a side 18 of a block 4. End stop blocks 40 are then inserted in opposite ends of the track 2 and are secured in place by threadably advancing set screws 42 into forceful engagement with the track 2.

As shown more particularly in FIG. 1, an electrical lead or wire 42 is terminated with an electrical contact 44, must commonly a conducting receptacle. In turn the receptacle 44 is mounted within a generally tapered dielectric housing 46. The housing 46 includes a forward relatively enlarged and tapered portion 48 and a rearward relatively reduced section encircling the lead 42. Shoulders 52 are defined at the intersection of the forward portion 48 and the rearward portion 50 of the back housing 46. The housings 46 are pluggably inserted into selected recesses 16 for electrically connecting the corresponding contacts 44 within the housings 46, making corresponding electrical connections within the terminal blocks 4 as disclosed in U.S. Pat. No. 3,824,553.

Figure 4:
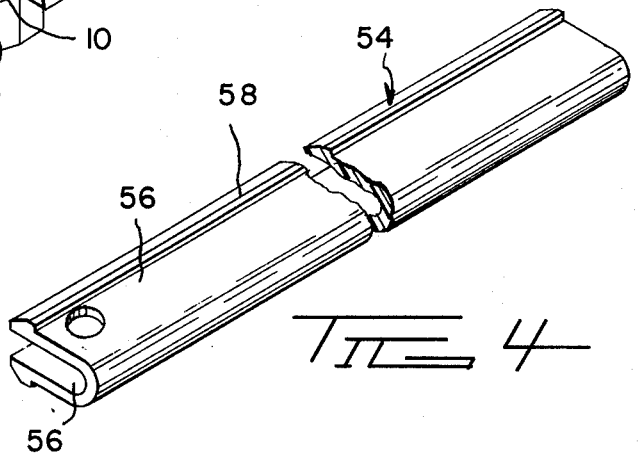
FIG. 4 is an enlarged perspective of a locking bar of the present invention.
Figure 3:
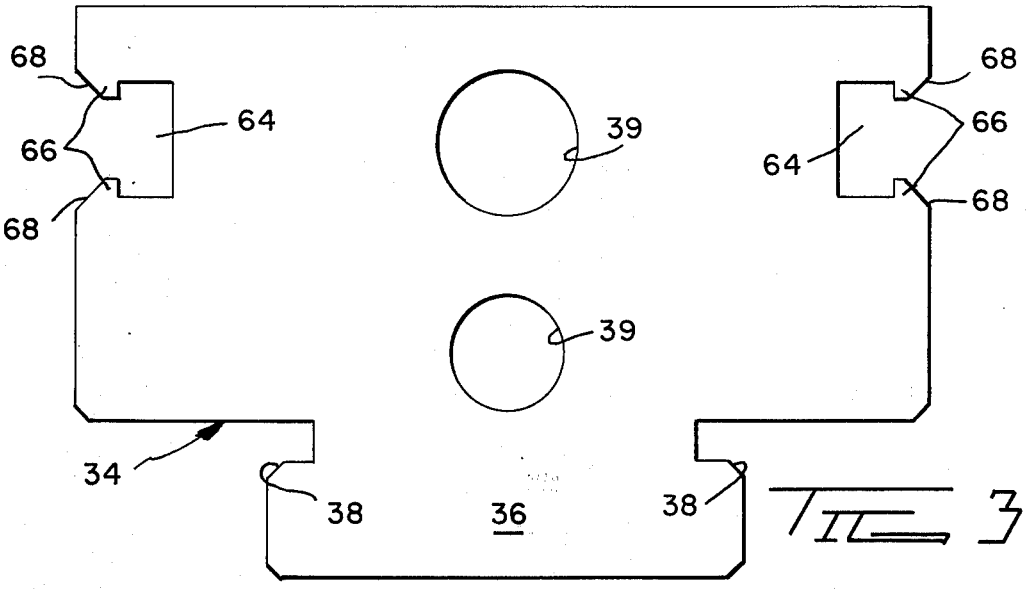
FIG. 3 is an enlarged perspective of an end plate for the locking bar shown in FIG. 1.

As shown in FIGS. 1, 3 and 4, a technique for preventing removal of the housings 46 will be disclosed in detail. In FIG. 4 there is illustrated a locking bar generally at 54 in the form of generally U-shaped dielectric extrusion, the extrusion having a pair of opposite resiliently deflectable arms or flanges 56 provided with outwardly projecting raised lips 58, the forward edges 60 of which are chamfered and the rearward edges 62 of which define shoulders at the intersections of the lips 58 with the corresponding arms or flanges 56.

As shown in FIGS. 1 and 3, each end plate includes projecting edge margins 62 which project outwardly beyond corresponding ends 12 and 14 of the blocks 4. Each edge margin 62 is provided with a notch 64 having a pair of opposed inwardly projecting teeth 66 at the entrance of each notch to define a narrow throat opening. Each of the teeth 66 is beveled at 68 to provide a funnel entry to the notch 64.

As shown in FIG. 1 the locking bar 58 bridges across the cluster of blocks 4 partially overlying or covering each of the adjacent double rows of cavities 16. The locking bar thus is disposed adjacent to the reduced rearward end portions 50 of the housings 46 that protrude from the cavities 16. The locking bar also overlies a corresponding shoulder 52 of each housing 46 such that any tendency of a housing 46 to be withdrawn from a corresponding cavity 16 will result in a shoulder 52 of the housing 46 engaging the locking bar 54 to prevent removal of the corresponding housing. Accordingly the locking bar 54 prevents inadvertent removal of any housing 46 from the terminal blocks 4. It is readily seen that the chamfered lips 58 of the locking bar will be readily inserted through the funnel entry 68 of each end plate 34. The flanges 56 are wedged resiliently toward each other when in corresponding notches 64 of the end plates thereby retaining the locking bar to the end plates. To further insure retention the flanges in the notches 64 of the teeth 66 engage behind the lip portions 58 latching the locking bar in the notch portions 64. Accordingly the notch portions 64 latchably retain a corresponding locking bar 54 in position on the assembly 1. To remove the locking bar

54 it is only necessary to pinch the flange portions 56 of the locking bar toward each other facilitating passage of the lip portions 58 through the clearance defined between the projecting teeth 66. As shown in FIG. 1, if a jumper connection is desired, a lead 42 may readily bridge a looped lead between selected cavities 16. The locking bar 54 is readily laterally slid back and forth even while latchably retained to the end plates 34 to allow insertion or removal of the locking bar lengthwise through the loop.

What has been shown and described is a preferred embodiment of the present invention. However other modifications and embodiments thereof which would be apparent to one having ordinary skill in the art are intended to be covered by the spirit and scope of the appended claims.

What is claimed is:

1. A locking bar assembly, comprising:

a channel shaped track, a plurality of dielectric blocks serially arranged along said track, a plurality of electrical leads terminated with corresponding electrical contacts, a pair of plates receiving therebetween said plurality of blocks, said plates having mutually aligned notch portions, dielectric housings having enlarged forward portions receiving said contacts and rearward portions of reduced cross-section from which said leads protrude, said blocks having cavities pluggably receiving corresponding forward portions of said housings therein with said rearward portions protruding from said cavities, a locking bar having resiliently flexible opposed flanges, said opposed flanges being resiliently compressed toward each other and thereby latchably received in a corresponding notch portion of each said plate, and said bar partially overlying said cavities of said blocks preventing withdrawal of said enlarged portions of said housings from said cavities.

2. The structure as recited in claim 1, wherein, said flange portions are provided with raised lip portions received within said notch portions, and said notch portions are provided with opposed projecting teeth preventing withdrawal of said lip portions from said notch portions.

3. The structure as recited in claim 2, wherein, said flange portions are chamfered for wedged entry past said teeth into said notch portions.

* * * * *